US005377467A

United States Patent [19]

Barnavol

[11] Patent Number: 5,377,467

[45] Date of Patent: Jan. 3, 1995

[54] LOCKING CLIP FOR PARTITION WALL PLATES

[76] Inventor: Charles Barnavol, 42 avenue Jeanne-d'Arc, F38100, Grenoble, France

[21] Appl. No.: 958,316

[22] PCT Filed: Jun. 12, 1991

[86] PCT No.: PCT/EP91/01090

§ 371 Date: Dec. 14, 1992

§ 102(e) Date: Dec. 14, 1992

[87] PCT Pub. No.: WO92/01123

PCT Pub. Date: Jan. 23, 1992

[30] Foreign Application Priority Data

Jul. 7, 1990 [DE] Germany ..... 4021756

[51] Int. Cl.[6] ..... E04B 2/76

[52] U.S. Cl. ..... 52/238.1; 52/243.1

[58] Field of Search ..... 52/238.1, 583.1, 587.1; 24/455, 458; 403/6, 321, 345, 405.1; 50/241, 243.1

[56] References Cited

U.S. PATENT DOCUMENTS

| | | | |
|---|---|---|---|
| 2,078,620 | 4/1937 | Venzie | 52/243.1 X |
| 4,037,380 | 7/1977 | Pollock | 52/243.1 X |
| 4,709,517 | 12/1987 | Mitchell | 52/243.1 X |
| 4,989,386 | 2/1991 | Collis | 52/583 X |
| 5,125,201 | 1/1992 | Pieters | 52/243.1 X |
| 5,125,203 | 6/1992 | Daw | 52/241 |
| 5,159,793 | 11/1992 | Deugo | 52/243.1 X |
| 5,212,924 | 5/1993 | Finkelstein | 52/583 |

*Primary Examiner*—Carl D. Friedman
*Assistant Examiner*—Beth A. Aubrey
*Attorney, Agent, or Firm*—Rogers, Howell & Haferkamp

[57] ABSTRACT

A locking element for securing edges of adjoining partition wall plates of the kind where two plasterboard plates are held spaced apart by cellular transverse ribs thereby to form a space between the plasterboard plates is disclosed. The locking element is completely insertable into the space adjacent an edge of a partition wall plate. The locking element comprises a guide casing having a width corresponding to the space between the plasterboard plates, and a pressure member between two positions wherein the pressure member in one end position projects beyond the edge of the partition wall plate and can be pressed against a spring force into the casing to a position fully housed in the guide casing in which the pressure member is received completely within the casing, at which housed position the pressure member can be engaged.

6 Claims, 3 Drawing Sheets

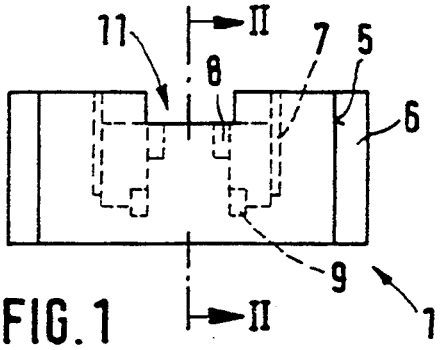
FIG. 1
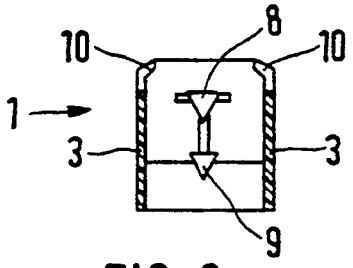
FIG. 2
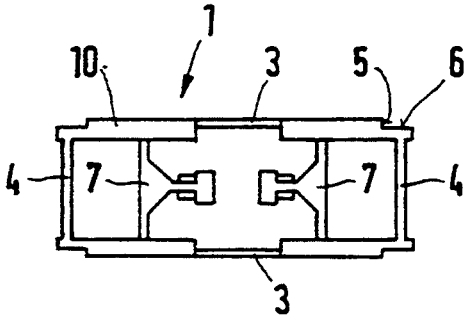
FIG. 3
FIG. 4
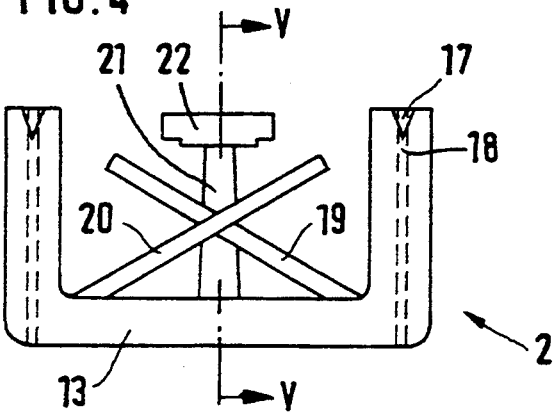
FIG. 5
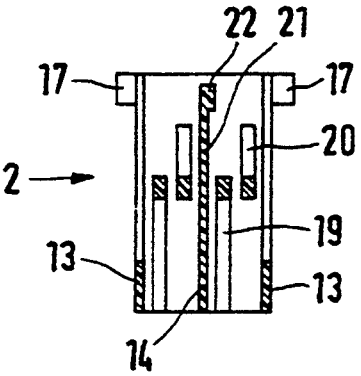
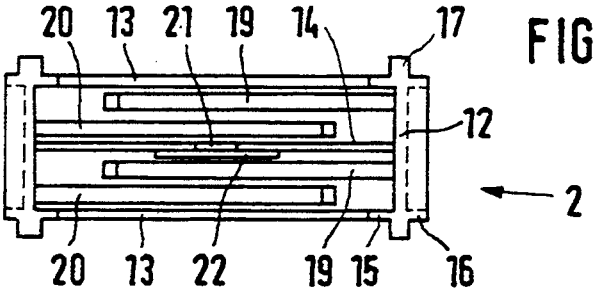
FIG. 6

FIG. 7
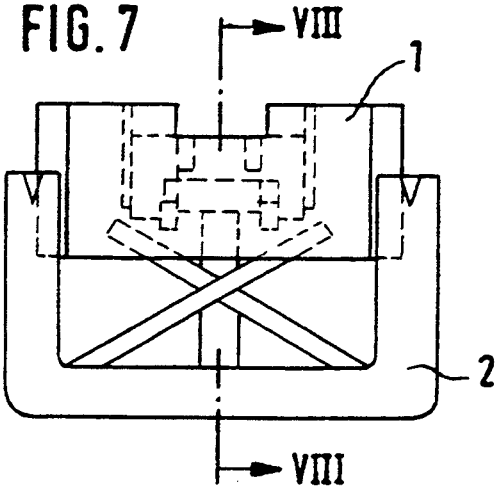
FIG. 8
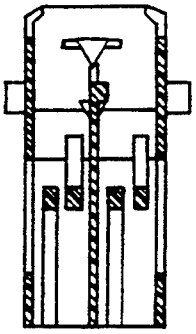
FIG. 9
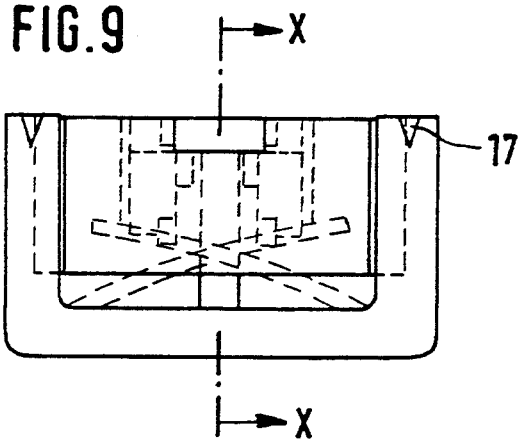
FIG. 10
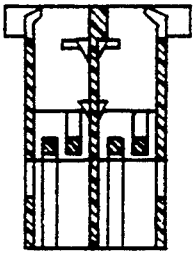
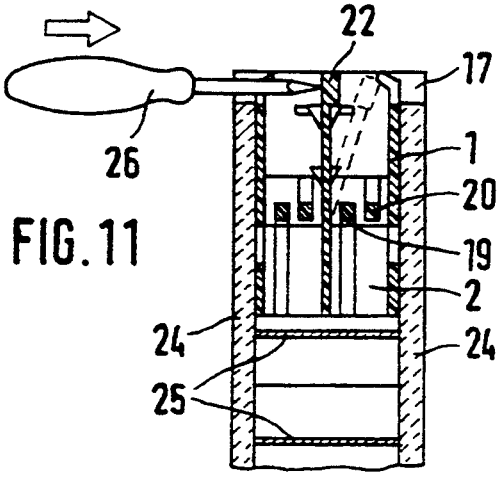
FIG. 11
FIG. 12
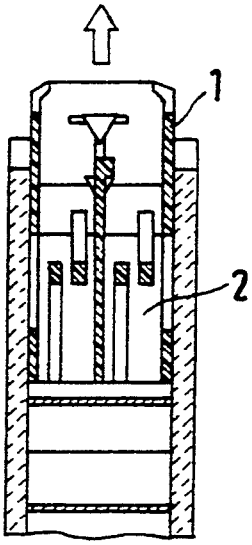

FIG. 13
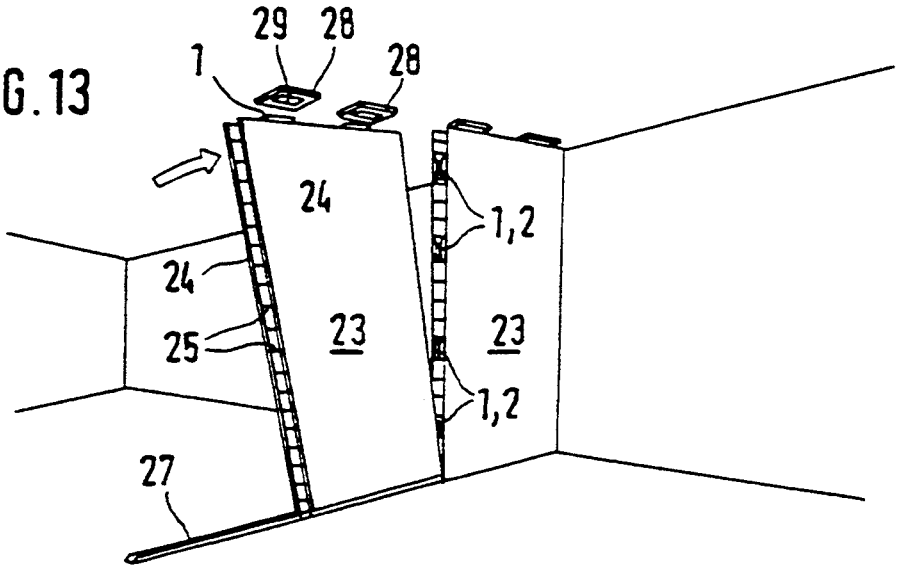
FIG. 14 a)
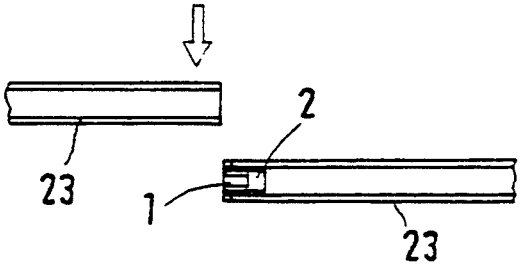
FIG. 14 b)
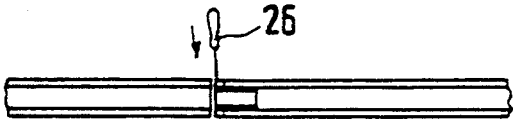
FIG. 14 c)
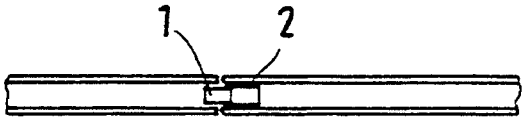
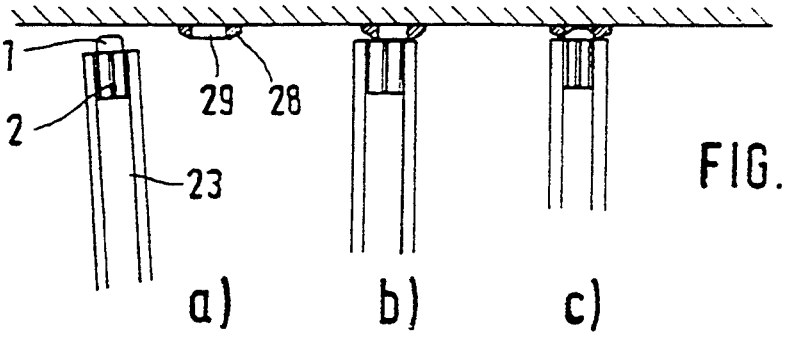
FIG. 15

LOCKING CLIP FOR PARTITION WALL PLATES

DESCRIPTION

The invention relates to a locking clip for fixing the edges of partition wall panels of the kind where two plasterboard panels are held spaced from each other by cellular transverse ribs.

In order to erect and fix these lightweight partition wall panels it is known from FR 2 634 239 to connect the walls together by connecting pieces which penetrate on both sides into the interspaces between the plasterboard panels so that the wall edges are fixed relative to each other. At the floor the partition wall panels are fixed by means of U-shaped profiled rails in to which the lower panel edge is turned and then screwed firm. At the side walls U-shaped profiled rails are likewise used into which the partition panel is inserted sideways. At the ceiling the fixing is by means of angular sections which are fixed from outside on to the top edge and are then screwed to the ceiling.

This known method of fixing using various profiled rails is very time-consuming and therefore expensive per fastening point. A further disadvantage is that the fixing sections at the ground and ceiling remain at least partially visible and must then additionally be covered for aesthetic reasons.

The object of the invention is therefore to provide a locking clip with which the edges of the aforesaid partition wall panels can be connected together quickly and simply and can be fixed to the side walls as well as to the floor and ceiling. Furthermore these clips should be easy to manufacture from plastics material so that the costs for each fixing point can be reduced.

This is achieved by the locking clip indicated in claim 1 which is characterized by the following advantages: The clip can be used equally well for fixing the wall panels together and for fixing the wall panels to the side walls and ceiling. The clip which is composed of a casing and pressure member is pressed at each proposed fixing point with the casing into the space between the plasterboard panels and when the pressure member is engaged is brought in front of the edge of the adjoining wall panel. The detent engagement is then released by pressing the retainer spring sideways so that then as a result of the resetting force of the sprung arms the pressure member slides halfway into the opposite space so that the wall edges are secured relative to each other.

Plastics panels must be fixed at the proposed fixing points on the side walls and ceiling, these panels being provided with rectangular recesses into which the pressure members can engage as the panel edge is swivelled past. These fixing plates are preferably dimensioned widthways so that their outer edges just close with the plasterboard panels.

Further details of the invention are given in the subclaims and will now be described in detail together with their advantages with reference to an embodiment of the invention illustrated in the drawings in which:

FIG. 1 shows the pressure member of the locking clip according to the invention in front view;

FIG. 2 is a cross-sectional view of the pressure member taken along the line II—II of FIG. 1;

FIG. 3 shows the pressure member in plan view;

FIG. 4 shows the casing of the locking clip according to the invention in front view;

FIG. 5 shows the casing in cross-section along the line V—V of FIG. 4;

FIG. 6 shows the pressure member in plan view;

FIG. 7 is a side view of a pre-assembled locking clip;

FIG. 8 shows the same locking clip in cross-section along the line VIII—VIII of FIG. 7;

FIG. 9 is a side view of the locking clip with the pressure member fully pushed in;

FIG. 10 shows the same locking clip in cross-section according to the line X—X in FIG. 9;

FIG. 11 shows a locking clip with the pressure member fully pushed in the edge area of a partition wall panel before disengagement of the pressure member;

FIG. 12 shows the same locking clip installed and after disengagement of the pressure member;

FIG. 13 shows the partition wall panels during erection in a room;

FIGS. 14 *a*) to *c*) show the operating sequence when locking the partition wall panels in the side area; and FIGS. 15 *a*) to *c*) show the operating sequence when locking the partition wall panels in the ceiling area.

The locking clip illustrated in the drawings is made from a hard elastic plastics and is comprised of a pressure member 1 and a casing 2 in which the pressure member 1 is guided movably in the installed state.

The pressure member 1 hereby consists of two longitudinal walls 3 and two cross walls 4 connected to same at right angles and is provided at the corners with guide faces 5 and 6 (FIGS. 1–3). On the inside there are two transverse webs 7 wherein an upper detent nose 8 and a lower detent nose 9 are molded opposite each other on each web. The side walls 3 have at the upper edge inwardly angled slide webs 10 which are inclined roof-shaped and which are broken in the center area by a recess which extends down into the side walls 3.

The associated guide casing 2 consists of two transverse walls 12 which are connected together U-shaped in the lower area through two outer longitudinal webs 13 and a center longitudinal web 14. The two outer webs 13 are hereby continued up along the transverse walls 12 inwards as guide webs 15 and outwards as reinforcement ribs 16. At the upper end of the guide webs 15 and reinforcement ribs 16 there are outwardly protruding wedge-shaped attachments 17 whose tips 18 point downwards.

Sprung arms 19 and 20 which are directed obliquely upwards are molded onto the opposite transverse walls 12 in their lower areas and each end just in front of the opposite counter wall 12 thereby crossing over one another. Furthermore still on the center web 14 there is a perpendicularly protruding spring web 21 with a transverse web 22 which stands T-shaped level with the casing edge and which interacts with the detent noses 8 and 9 of the pressure member 1 so that the pressure member 1 can be locked both at half and full insertion depth (cf. FIGS. 7/8 and 9/10). In the first instance the pressure member 1 rests with its transverse ribs 7 loose on the ends of the sprung arms 19 and 20 whilst in the second case the sprung arms 19 and 20 are bent down.

As can be seen from FIG. 13, the locking clip is intended to secure the edges relative to each other or against the ceiling when erecting the partition wall panels 23 in rooms. These are partition wall panels 23 of known kind wherein two plasterboard panels 24 are held spaced from each other by transverse ribs 25 arranged in cells or honeycomb manner.

The method of operating the locking clip is clearly shown in FIGS. 11 and 12. The clip is first pressed into the partition wall panel 23 until the wedge-shaped attachments 17 are engaged fully in the edge of the plasterboard panels 24. The casing 2 hereby enters the space between the plasterboard panels 24 and simultaneously presses the cellular transverse ribs 25 on both sides. In order to free the pressure member 1 from its locked position a flat tool such as a screw driver 26 is used to press the spring web 21 with the transverse web 22 towards the side until the upper detent nose 8 passes the transverse web 22 and the pressure member 1 is pushed upwards as a result of the resetting force of the sprung arms 19 and 20. A recess 11 is provided in the longitudinal walls 3 in the pressure member 1 for the insertion of the screw driver 26.

FIG. 13 illustrates the erection of the partition wall panels 23 in a room wherein the right-hand panel 23 is already fixed on the floor and on one side wall by means of an assembly strip 27 and at the ceiling by means of the locking clip. The next panel 23 is already standing with its ground edge on the assembly strip 27 and has just been swivelled up. The locking clips 1/2 are installed in the side edge of the already standing panel 23 with the pressure members 1 fully sunk in so that the next panel 23 passes by easily with its right-hand outside edge.

Oblong plates 28 are fixed on the ceiling and these plates have recesses 29 into which the locking clips 1,2 inserted in the upper edge engage after the panel 23 is swivelled up whereby the slide webs 10 ensure that the pressure members 1—like a door catch—spring back along the inclined face (cf FIGS. 15 *a*) to *c*) ).

As soon as the panel 23 stands upright and the upper pressure members 1 have engaged in the recesses 29 of the plates 28, the transverse webs 22 of the spring webs 21 are pushed by the tool 26 away through the recess 11 (FIG. 14*b*) so that the pressure members along the side edge can enter into the opposite side edge of the next partition panel 23 (FIG. 14*c*).

I claim:

1. A locking element adapted for securing edges of adjoining partition wall plates of the kind where two plasterboard plates are held spaced apart by cellular transverse ribs thereby to form a space between the plasterboard plates, the locking element being configured and oriented such that it is completely insertable into the space adjacent an edge of a partition wall plate, the locking element comprising a guide casing having a width corresponding to the space between the plasterboard plates, and a pressure member that, when the guide casing is seated in the space between the plasterboard plates adjacent the edge of the partition wall plate, is movably guidable in the casing between a first position and a fully housed position wherein the pressure member in the first position projects beyond the edge of the partition wall plate and from which first position the pressure member can be pressed against a biasing force into the casing to the fully housed position in which the pressure member is received completely within the guide casing, the guide casing including means for engaging the pressure member, at the fully housed position to maintain the pressure member from projecting beyond the edge of the partition wall plate.

2. The locking element according to claim 1, inside the casing wherein the casing has a forward edge and a back wall and includes a recess extending from forward edge of the casing to the back wall inside the casing and the pressure member is movably guided in the recess, and the locking element further comprises a web molded inside the casing on the back wall of the casing, the web being designed to spring away transversely with respect to movement of the pressure member guided in the casing, terminating in a transverse arm to form a T, and standing T-shaped level with the forward edge of the casing and interacts with first and second pairs of two noses per pair, the noses of the first pair being molded on the pressure member at a first level and the noses of the second pair being molded on the pressure member at a second level, such that the first pair of noses serves to secure the pressure member in a position in which it extends into the recess in the casing approximately halfway from the forward edge to the back wall of the casing and the second pair of noses is fitted so that the pressure member is held secure in the fully housed position in which the pressure member extends into the recess to the back wall of the casing.

3. The locking element according to claim 2 wherein the pressure member has a leading edge that faces the back wall of the casing when the pressure member is in the fully housed position and a trailing edge opposite the leading edge and an oblong recess is provided on the trailing edge of the pressure member at approximately the level of the transverse arm when the pressure member is in the fully housed position.

4. The locking element according to claim 3 where in the trailing edge of the pressure member has slide webs that are inclined in a roof-shaped manner.

5. The locking element according to claim 2 wherein the pressure member has side walls having trailing edges at a position away from the back wall of the casing when the pressure member is in the fully housed position and has slide webs that are inclined in a roof-shaped manner.

6. The locking element according to claim 1 wherein the spring force is produced by each of two pairs of spring arms which are molded in the casing on opposite transverse wall of the casing beyond a point to which the pressure member extends in the fully housed position and which are aligned obliquely outwardly of the casing crossing one another so that four protruding ends of the spring arms form a flat support for the pressure member.

* * * * *